United States Patent [19]

Ikesue

[11] 4,377,888

[45] Mar. 29, 1983

[54] BUCKLE OF A SEAT BELT FOR A VEHICLE

[75] Inventor: Haruyuki Ikesue, Fujisawa, Japan

[73] Assignee: NSK-Warner K. K., Tokyo, Japan

[21] Appl. No.: 212,622

[22] Filed: Dec. 3, 1980

[30] Foreign Application Priority Data

Dec. 19, 1979 [JP] Japan ..... 54-174757[U]

[51] Int. Cl.[3] ..... A44B 11/26

[52] U.S. Cl. ..... 24/230 A

[58] Field of Search ..... 24/230 A, 230 AK, 230 AL, 24/230 AP, 178

[56] References Cited

U.S. PATENT DOCUMENTS

| | | | |
|---|---|---|---|
| 3,588,969 | 6/1971 | Fisher | 24/230 A |
| 3,790,994 | 2/1974 | Jakob | 24/230 A |
| 3,807,000 | 4/1974 | Weman | 24/230 AL |
| 4,052,775 | 10/1977 | Gavagan et al. | 24/230 |
| 4,127,922 | 12/1978 | Mita | 24/230 |
| 4,195,392 | 4/1980 | Ueda et al. | 24/230 A |
| 4,196,500 | 4/1980 | Happel et al. | 24/230 AL |

*Primary Examiner*—Robert P. Swiatek

*Attorney, Agent, or Firm*—Shapiro and Shapiro

[57] ABSTRACT

A buckle body has a base member, a latch member for engaging with a tongue, and a push button member for operating the latch member. The latch member is generally rectangular and is pivotably supported in the opposed holes of the base member while being biased to a tongue-locking position. The push button member operates the latch member by means of legs contacting the side edge portions of the latch member which extend outwardly through the opposed holes of the base member.

4 Claims, 9 Drawing Figures

BUCKLE OF A SEAT BELT FOR A VEHICLE

BACKGROUND OF THE INVENTION

1. Field of the Invention

This invention relates to a buckle for use with a seat belt for vehicles.

2. Description of the Prior Art

Now that the recognition of the importance of the seat belt for vehicles such as automotive vehicles is rising and there is a tendency to make it obligatory to mount a seat belt in automotive vehicles or the like, buckles have been more and more desired which are sturdy and compact in construction and in which the engagement between the buckle body and the tongue is reliable. Some of known buckles considerably satisfy such requirements, but many of them have a disadvantage that they require a number of parts and it is difficult to assemble these parts.

SUMMARY OF THE INVENTION

It is therefore an object of the present invention to provide a buckle for seat belt which is sturdy and compact in construction, in which the engagement between the buckle body and the tongue is reliable and the disengagement of the tongue from the buckle body is smooth, and which is easy to assemble.

The invention will become fully apparent from the following detailed description thereof taken in conjunction with the accompanying drawings.

Preferred embodiments of the present invention will hereinafter be described by reference to the drawings.

Figure 1:
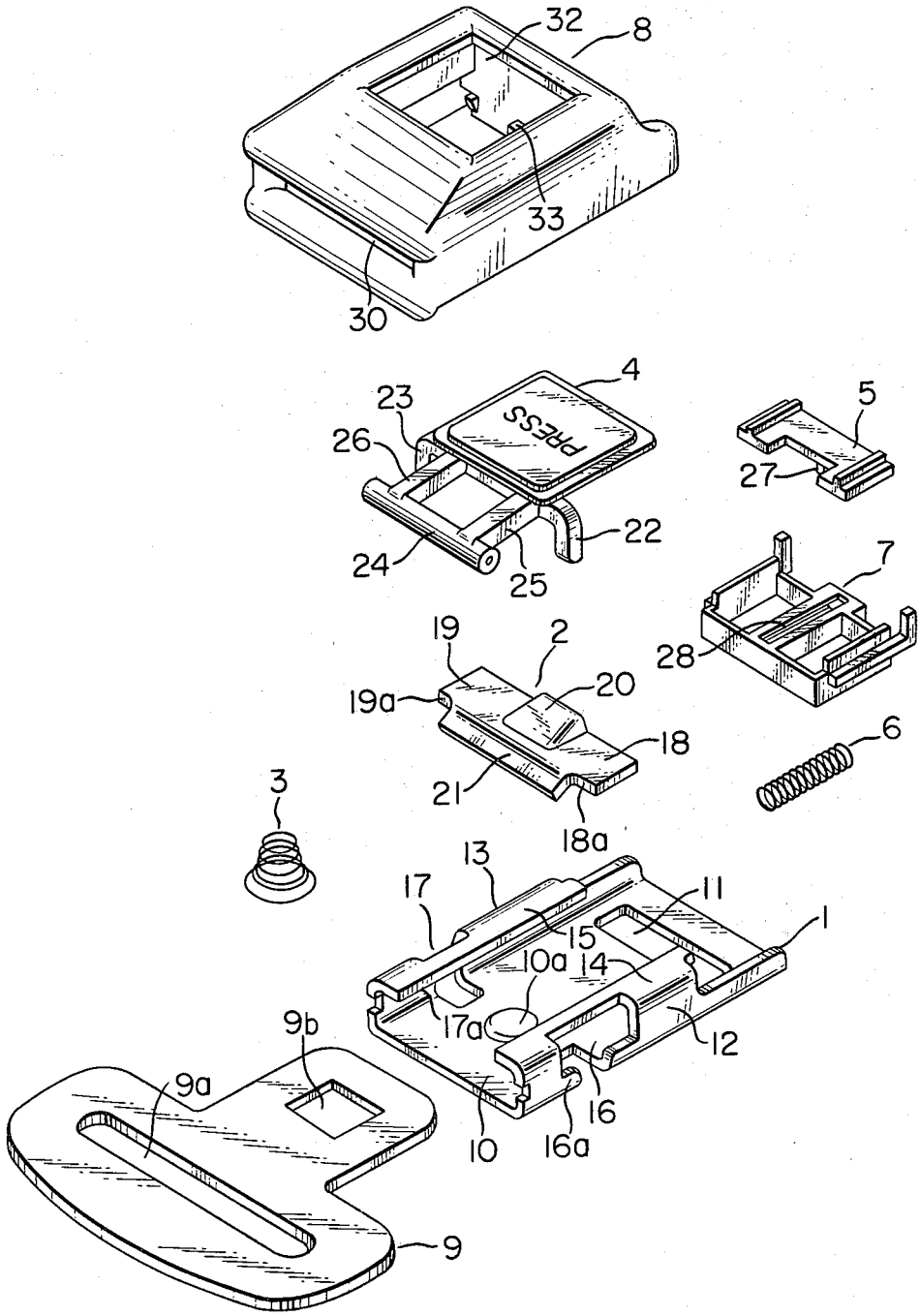
FIG. 1 is an exploded perspective view of a first embodiment of the present invention.

As shown in the exploded perspective view of FIG. 1 a first embodiment of a buckle comprises a buckle body comprising a buckle base 1; a latch member 2; a conical coil spring 3 for biasing the latch member; a push button 4; a slider assembly for expelling a tongue including a slider 5, a coil spring 6 and a coil spring case 7, and a cover 8; and a tongue 9 having a slot 9*a* through which webbing may be passed and an aperture 9*b* for engaging with the latch member.

Figure 2:
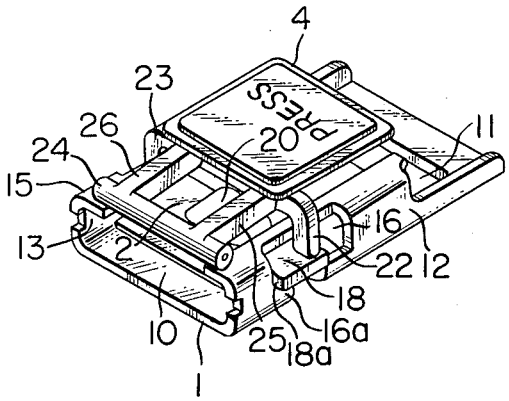
FIG. 2 is a perspective view showing the first embodiment before a slider assembly is incorporated.

The base 1 has a central flat portion 10 and, near the lengthwise end thereof, it as an opening 11 through which unshown webbing may be passed and secured. Side portions 12 and 13 rising substantially at right angles with the flat portion 10 are formed on the opposite sides of the base 1, and the upper end portions of these side portions 12 and 13 form inwardly bent portions 14 and 15. Near the lengthwise forward end (herein, the forward end of the buckle body refers to that end into which the tongue is inserted) of the side portion 12, there is formed a hole 16 whose bottom portion somewhat extends into the flat portion 10. In that portion of the side portion 13 which is opposed to the hole 16, there is formed a hole 17 which has a configuration of the hole 16 with the rear portion thereof cut away. The lengthwise extent of the holes 16, 17 are sufficient to receive lugs 18 and 19 for positioning formed on the opposite sides of the latch member 2, and support portions 16*a* and 17*a* located forwardly of the holes 16 and 17 rise substantially at right angles with the flat portion 10 and provide the supporting surfaces for the force end portions 18*a* and 19*a* of the lugs 18 and 19 of the latch member 2. Further the lengthwise extent of hole 16 is sufficient to permit the latch member to pass therethrough. The generally rectangular latch member 2, as shown in FIG. 2, is placed on the flat portion 10 with the lugs 18 and 19 contained in the holes 16 and 17 and with the fore end portions 18*a* and 19*a* of the lugs 18 and 19 resting on the support portions 16*a* and 17*a*, and is normally biased upwardly by the conical coil spring 3 installed around a circular projection 10*a* formed on the flat portion 10. An upwardly projected latch portion 20 is formed in the rear central portion of the latch member 2, and a portion 21 slightly downwardly bent to increase the rigidity of the latch portion 2 is formed in the fore portion of the latch member. The purpose of the portion 21 being downwardly bent is to facilitate the insertion and guide of the tongue 9 into the buckle body and to prevent it from engaging the surface of the tongue 9 during mesh engagement. Also, as shown in FIG. 2, the latch member 2 is designed such that when it is installed in its predetermined position, the rear upper surfaces of the lugs 18 and 19 projected outwardly of the holes 16 and 17 contact legs 22 and 23 of the push button 4. Thus, the latch portion 20 can engage the aperture 9*b* by the tongue 9 being inserted between the latch member 2 and the bent portions 14, 15. The push button 4 is pivotable about a shaft portion 24 pivotably positioned at the support portion (not shown) of the fore inner surface of the cover 8, thereby operating the latch member 2. Also, the portion of the push button 4 which may be pressed by a finger and the shaft portion 24 are coupled together by bridge portions 25 and 26 lengthwisely extending, and the length of the arm from the shaft portion 24 to that portion to which the force of the finger is imparted is made great to lighten the operation of the latch member 2.

Figure 3:
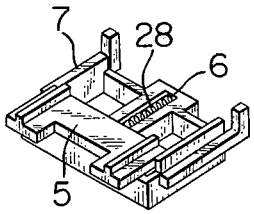
FIG. 3 is a perspective view of slider assembly.
Figure 4:
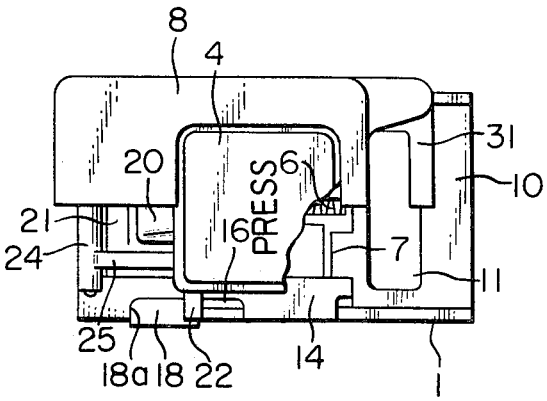
FIG. 4 is a plan view of the first embodiment with the cover partly broken away and before the tongue is inserted.
Figure 6:
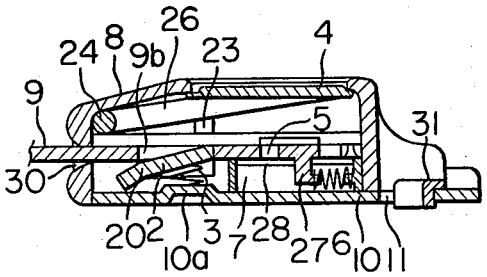
FIG. 6 is a central longitudinal cross-sectional view of the first embodiment as it is in the condition of FIG. 4.

The slider 5 serves to cause the tongue 9 to jump forwardly of the buckle body when the tongue 9 is released by the push button 4. The slider 5 has an L-shaped projection 27 rearwardly extending on its underside, and this projection 27 extends into a goove 28 formed in the central portion of the coil spring case 7. As shown in FIG. 3, the coil spring 6 is contained in the groove 28 and further, as shown in FIG. 6, the projection 27 fits in the fore end portion of the coil spring 6, whereby the slider 5 is normally biased forwardly. Such slider assembly rests on the rear half of the flat portion 10 of the base 1. The cover 8 is in the form of an open-bottomed box and is secured to the base 1 so as to cover the members on the base 1. A rectangular opening 30 through which the tongue 9 may be inserted is formed in the front face of the cover 8, and a bridge portion 31 extending so as to cover the rear edge of the hole 11 of the base 1 is formed in the rear portion of the cover 8, as shown in FIG. 4. This bridge portion 31 serves to prevent the webbing inserted into the hole 11 from being severed by the corners of the hole 11. An opening 32 for exposing the portion of the push button 4 which is to be depressed by a finger is formed in the upper surface of the cover 8. Further, a projection 33 is formed in the rear inner surface of the cover 8, which serves to prevent the push button 4 with the shaft portion 24 thereof brought into the aforementioned support portion of the fore inner surface of the cover 8 from falling from the cover 8 during the assembly of the buckle body.

Figure 5:
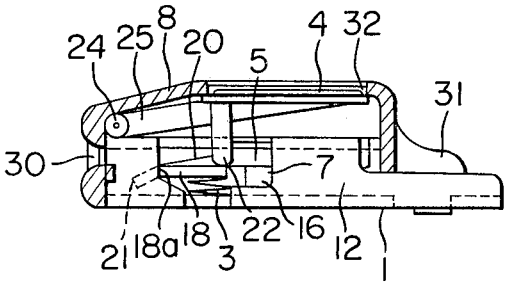
FIG. 5 is a side view of FIG. 4.
Figure 7:
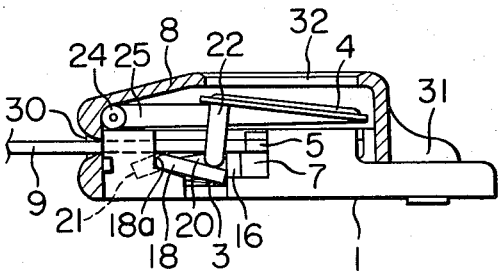
FIG. 7 is a side view of the first embodiment with the cover partly broken away and in a condition in which the tongue is about to be disengaged.

Description will now be made of the operation of the embodiment having the above-described construction. With the tongue 9 not yet inserted through the opening 30, the latch member 2 and the push button 4 are stable at their positions in which they have been pivoted to the upper limit, as shown in FIGS. 4 and 5, and the slider 5 is stable in its condition in which it has moved to the lengthwise foremost position of the stroke thereof. Here, when the tongue 9 is inserted through the opening 30 after the wearing of the seat belt, the fore end of the tongue 9 contacts the latch portion 20 of the latch member 2 to rotate it downwardly against the biasing force of the spring 3. When the tongue is further forced in and the latch portion 20 is engaged with the aperture **9*b* of the tongue 9, the latch member 2 is again rotated upwardly by the spring 3 to return to its original position and lock the tongue 9 so that it cannot be withdrawn out of the buckle body. At the same time, the slider 5 is pushed by the fore end of the tongue 9 and slides rearwardly against the biasing force of the spring 6 and, with the tongue 9 being in its locked condition, the spring 6 is in a condition in which it stores its restoring force therein. This condition is shown in FIG. 6. Here, when the push button 4 is downwardly depressed to cause the tongue 9 to be disengaged from the buckle body, the latch member 2 is rotated downwardly against the biasing force of the spring 3 to thereby release the locking action of the latch portion 20, as shown in FIG. 7. Simultaneously therewith, the slider 5 is quickly caused to slide forwardly by the spring 6 and expels the tongue 9** forwardly.

The present embodiment has not only the above-described features but also the following features. (1) Due to the support portions **16*a* and 17*a* of the holes 16 and 17, the latch member 2 in the tongue locking position is substantially parallel to the flat portion 10 and the lock release is relatively light. (2) The presence of the forwardly bent portion 21 in the latch member 2 increases the rigidity and strength of the latch member 2. (3) By adopting the form of the slider assembly, the assembly of the buckle body becomes possible by finally assembling the slider assembly; the subassembly of the cover 8 and the push button 4; and the subassembly of the base 1, the spring 3 and the latch member 2**, and thus, the assembly of the buckle body is simplified and further, the way to automatization is open.

A second embodiment of the present invention in which the form of the push button has been changed to a different one will now be described by reference to FIG. 8. In the second embodiment, reference characters indentical with those in the first embodiment disignate identical parts of members. In the second embodiment, a push button 40 is contained in a cover 41 so as to be slidable in the direction in which the tongue is inserted, and is biased lengthwisely forwardly by a coil spring 42, and a lever member 43 as shown in FIG. 9 is provided for pivotal movement about shaft protions 46, 47 with the legs 44 and 45 of the lever member being in contact with the lugs 18 and 19 of the latch member 2. The shaft portions 46 and 47 are pivotably supported by the support portion, not shown, formed on the inner surface of the cover 41.

Figure 8:
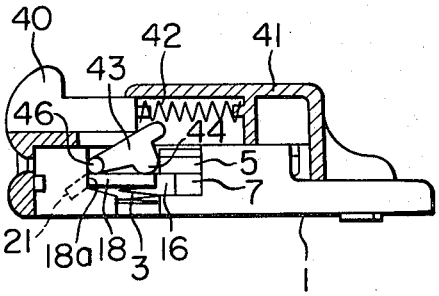
FIG. 8 is a side view of a second embodiment of the present invention with the cover partly broken away.
Figure 9:
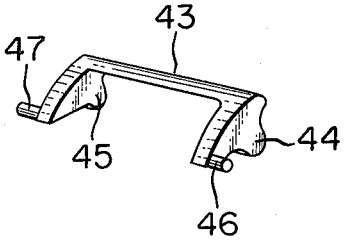
FIG. 9 is a perspective view showing a lever member which constitutes the second embodiment.

In the second embodiment, when the push button 40 is moved lengthwisely rearwardly, the lever member 43 is rotated clockwisely about the shafts 46, 47, as viewed in FIG. 8, to thereby push the latch member 2 downwardly. In the other points, the second embodiment is similar to the first embodiment.

According to the present invention, as has been described above, a buckle can be provided in which the shape of the latch member is simple and which is easy to assemble and sturdy and compact.

What is claimed is:

1. A seat belt buckle including a buckle base, a generally rectangular latch member pivotably supported by said buckle base and having a latch portion, said buckle base having a flat portion and opposite side portions rising from opposed longitudinal side edges of said flat portion and having opposed holes for pivotably supporting said latch member, a tongue having an engaging portion for engaging said latch portion, said latch member having shorter opposite side edges extending outwardly through the opposed holes in the buckle base, said latch member being biased upwardly toward a tongue-locking position, in which said tongue is connected with said buckle base, while being pivotable substantially about a forward end surface of said shorter opposite side edges thereof, operating means for bringing said latch member from the tongue-locking position to a tongue-releasing position in which said tongue is released from said buckle base, said operating means including a member having leg portions and a lateral shaft, said leg portions engaging the opposite side edges of said latch member and being pushed downwardly about said lateral shaft integral therewith when said operating means is manually operated, thereby bringing said latch member to the tongue-releasing position about said forward end surface thereof, wherein at least one of the opposed holes of said buckle base has an extent lengthwise of the base that permits said latch member to pass therethrough.

2. A buckle according to claim 1, further including a slider for expelling said tongue in the direction opposite to the direction in which the tongue is inserted, when said latch member is brought to the tongue-releasing position, said slider being biased toward a forward end of said buckle base by a biasing member contained in a case disposed on the rear portion of said buckle base and being slidable on said case lengthwise of said buckle base.

3. A buckle according to claim 1, wherein forward portions of the opposed holes of said buckle base are formed with support portions rising from said flat portion to form a stepped shape, and forward portions of the opposite side edges of said latch member rest on said support portions.

4. A buckle according to claim 1, wherein said latch member has a first flat portion extending rearward of the pivot axis passing through the front end surface of said opposite side edges, and a second flat portion extending forward of said pivot axis and being downwardly bent with respect to said first flat portion and narrower than said first flat portion.

* * * * *